US012766395B2

(12) United States Patent
Lindblom

(10) Patent No.: US 12,766,395 B2
(45) Date of Patent: Oct. 20, 2026

(54) EXTENDABLE AND RETRACTABLE TRAINING DEVICE FOR SNOWBOARDING

(71) Applicant: Margaret Catherine Ney Lindblom, Bedford, MA (US)

(72) Inventor: Margaret Catherine Ney Lindblom, Bedford, MA (US)

( * ) Notice: Subject to any disclaimer, the term of this patent is extended or adjusted under 35 U.S.C. 154(b) by 1196 days.

(21) Appl. No.: 17/654,480

(22) Filed: Mar. 11, 2022

(65) Prior Publication Data

US 2023/0285822 A1 Sep. 14, 2023

(51) Int. Cl.
*A63B 69/00* (2006.01)

(52) U.S. Cl.
CPC ..... *A63B 69/0093* (2013.01); *A63B 2210/58* (2013.01); *A63B 2214/00* (2020.08)

(58) Field of Classification Search
CPC ..... A63B 69/0064; A63B 69/0093; A63B 2225/09; A63B 69/18; A63B 2208/12; A63B 2244/19; A63C 11/00
See application file for complete search history.

(56) References Cited

U.S. PATENT DOCUMENTS

| | | | | |
|---|---|---|---|---|
| 5,120,227 | A | 6/1992 | Born | |
| 5,378,156 | A | 1/1995 | Rohe | |
| 6,341,614 | B1 | 1/2002 | Tucker et al. | |
| 6,592,377 | B2 | 7/2003 | Bendele, Jr. | |
| 8,113,999 | B2 | 2/2012 | Falter | |
| 8,721,343 | B2 | 5/2014 | Davis | |
| 9,446,295 | B2 | 9/2016 | Matte | |
| 9,950,233 | B2 | 4/2018 | Bilbao | |
| 2011/0006504 | A1 | 1/2011 | Arnol | |
| 2014/0272857 | A1* | 9/2014 | Winder | A63B 69/18 434/253 |
| 2014/0335492 | A1 | 11/2014 | Braaten | |
| 2015/0031007 | A1 | 1/2015 | Ruiz | |
| 2020/0001160 | A1 | 1/2020 | Williamson | |
| 2021/0101063 | A1 | 4/2021 | Sudit | |
| 2021/0213343 | A1 | 7/2021 | Gotthelf et al. | |

* cited by examiner

*Primary Examiner* — Peter S Vasat
(74) *Attorney, Agent, or Firm* — Dunlap Bennett & Ludwig PLLC

(57) ABSTRACT

A training device for teaching a user how to snowboard is disclosed. The training device includes a telescoping unit, a hinge unit, a locking mechanism, and a handlebar. The telescoping unit includes telescoping sections that are slidably coupled with one another, with a first end of the telescoping unit including a grip. The hinge unit is coupled to a second end of the telescoping unit. The locking mechanism is adjustably coupled to the hinge. The handlebar is coupled to the hinge a center region thereof such that opposing longitudinal distal ends of the handlebar are spaced from the hinge unit. Further, the handlebar is rotatable between: a first position, where the handlebar extends substantially perpendicular relative to the telescoping unit, and a second position, where the handlebar extends substantially parallel relative to the telescoping unit.

11 Claims, 5 Drawing Sheets

EXTENDABLE AND RETRACTABLE TRAINING DEVICE FOR SNOWBOARDING

BACKGROUND OF THE INVENTION

The present invention relates to teaching and, more particularly, to an extendable and collapsible teaching device for teaching an individual how to snowboard.

Snowboarding is a challenging sport to conquer. It involves using an oversized board to traverse down a snow-covered slope. Snowboarding requires a rider to perform a great deal of weight shifting while at the same time retaining their center of gravity over the snowboard to maintain balance and traverse the slope. This can be very difficult to accomplish when first learning the sport and may result in numerous falls and the danger of serious injury.

Existing tools for educating students how to ski or snowboard are bulky and/or suboptimal devices. As snowboarding involves a lot of moving around, including traveling up the slope to get to where the descent begins, carrying around a bulky device is impractical and inconvenient.

Other devices are also used, such as hoops and harnesses that wrap around the student to guide a child learning to ski or snowboard. These are especially hard to handle while getting on and off a ski lift. It can create an unsafe situation when skiing or riding at a mountain with a student and only having one hand free. Using a hoop that goes around the student requires an instructor to use one hand to hold the band and only have one free hand to help a student get on the lift. Harnesses require significant time to get it properly arranged on the student.

As can be seen, the need for a teaching device that aids in maintaining balance and is also highly portable is evident.

SUMMARY OF THE INVENTION

In one aspect of the present invention, a training device for snowboarding is disclosed, with the training device comprising: a telescoping unit comprising a plurality of telescoping sections that are slidably coupled with one another, with a first end of the telescoping unit comprising a grip; a hinge unit coupled to a second end of the telescoping unit; a locking mechanism adjustably coupled to the hinge; and a handlebar coupled to the hinge a center region thereof such that opposing longitudinal distal ends of the handlebar are spaced from the hinge unit, with the handlebar being rotatable between: a first position, where the handlebar extends substantially perpendicular relative to the telescoping unit, and a second position, where the handlebar extends substantially parallel relative to the telescoping unit.

In another aspect of the present invention, a method of teaching snowboarding is disclosed, with the method comprising the steps of: providing the aforementioned training device; removing the training device from a storage location; sliding the plurality of telescoping sections to an extended position; rotating the handlebar from the second position to the first position; and adjusting the locking mechanism to lock the handlebar in the first position.

The training device of the present invention is advantageously compact enough, in a retracted position, that it can be folded up to fit in a pocket. This makes it easy to carry around the mountain with you. Compared to the prior art, the present invention is the only device that can be folded up such that it can be transported easily (e.g., in a pocket or backpack). Thus, when a teacher or other individual needs both hands free, the training device can be easily stowed away.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
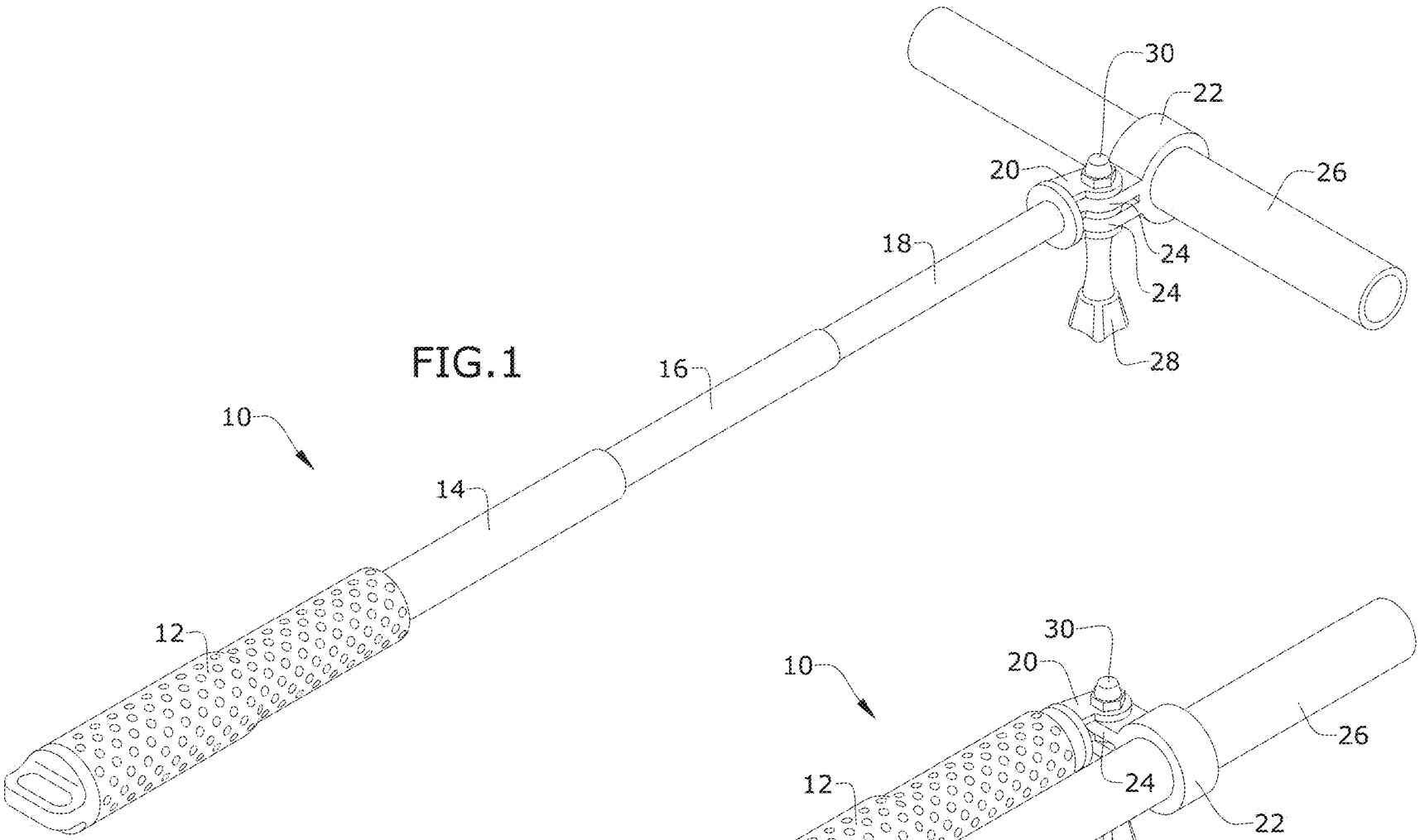
FIG. 1 is a perspective view of an embodiment of the present invention, shown in an extended, in-use position.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured Broadly, one embodiment of the present invention is an extendable and retractable training device for snowboarding that includes a telescoping unit, a hinge unit, a locking mechanism, and a handlebar.

Referring now to FIGS. 1-6, an extendable and retractable training device 10 generally includes: a grip or handle 12, a plurality of telescoping sections 14, 16, 18, a hinge 20, a hinge ring 22, a locking mechanism 28, 30, and a handlebar 26.

Figure 2:
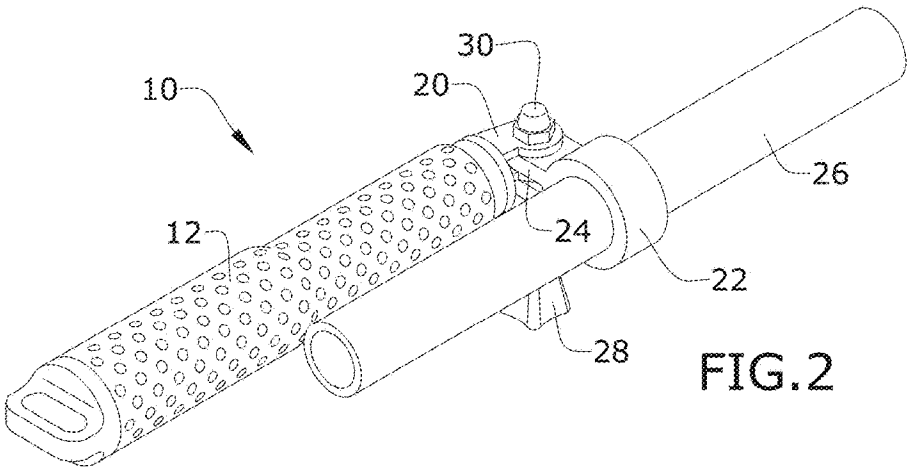
FIG. 2 is a perspective view of an embodiment of the present invention, shown in a retracted, storage position.
Figure 3:
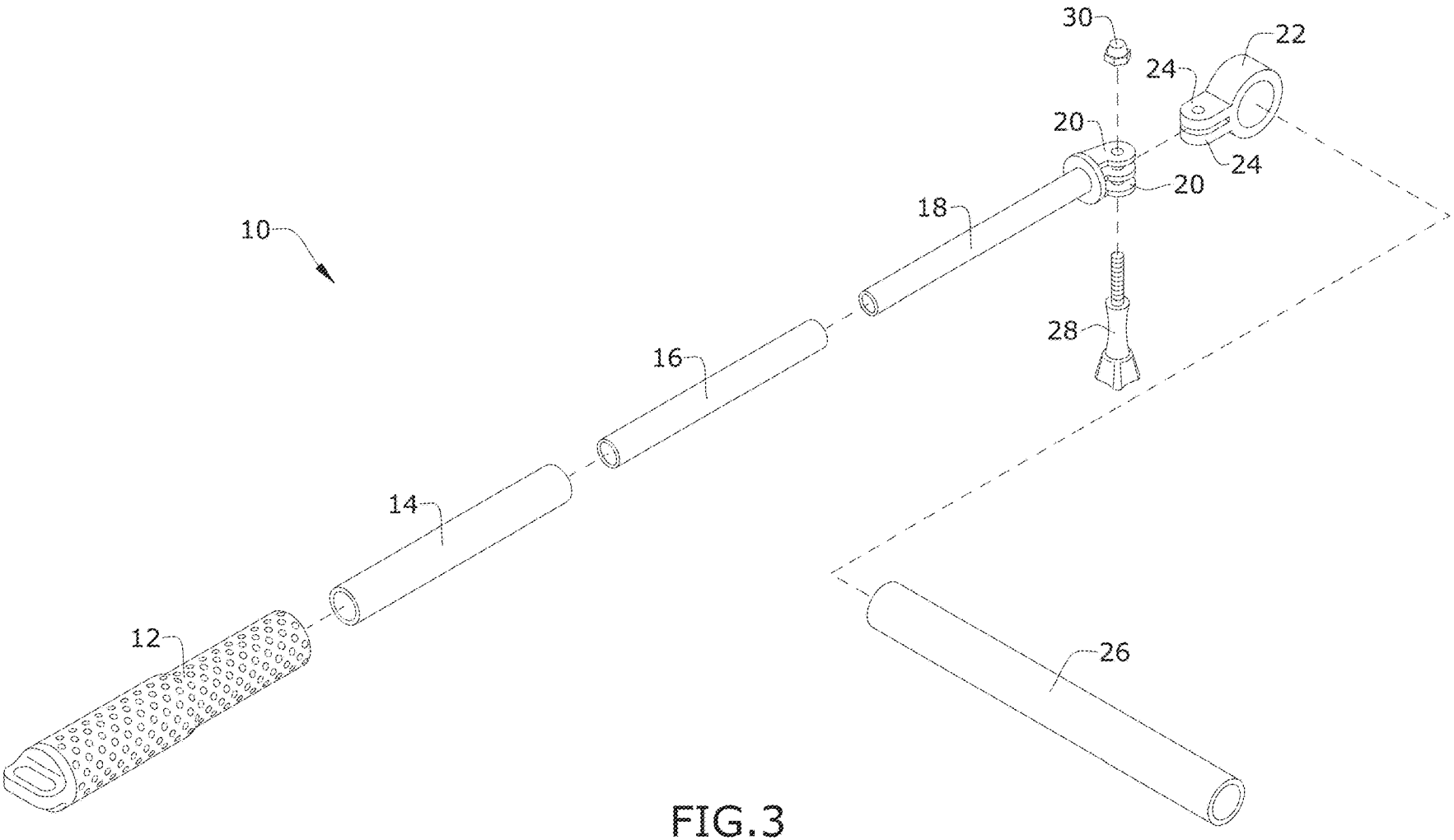
FIG. 3 is an exploded view of the embodiment of the present invention.

As shown in FIGS. 1 and 2, the grip 12, the first telescoping section 14, the second telescoping section 16, third telescoping section 18, and hinge 20 collectively form a telescoping unit which can be selectively retracted (FIG. 2) and extended (FIG. 1). The telescoping unit is lockable such that varying lengths can be achieved, which is useful when users need greater or smaller distancing between a trainer 34 and a student 32.

The hinge 20 is disposed on an opposite side of the telescoping unit relative to the grip 12. The hinge ring 22 is rotatably coupled to the hinge 20 via hinge fingers 24, with a locking mechanism 28, 30 extending on opposite sides and through the hinge fingers 24. The hinge 20 and hinge ring 22 collectively form a hinge unit. The locking mechanism 28, 30 is adjustable to selectively lock and unlock the handlebar 26 in its position. For example, the locking mechanism 28, 30 can lock the handlebar 26 such that it extends perpendicular to the telescoping unit (FIG. 1), and it can also lock the handlebar 26 such that it extends parallel to the telescoping unit (FIG. 2).

In certain embodiments, the locking mechanism 28, 30 may include an adjustment member 28 which is threaded onto a connector 30. Thus, rotation of the adjustment member 28 selectively applies and releases pressure on the hinge joint at the fingers 24, thus locking and unlocking the handlebar 26 for rotation, as needed.

Figure 4:
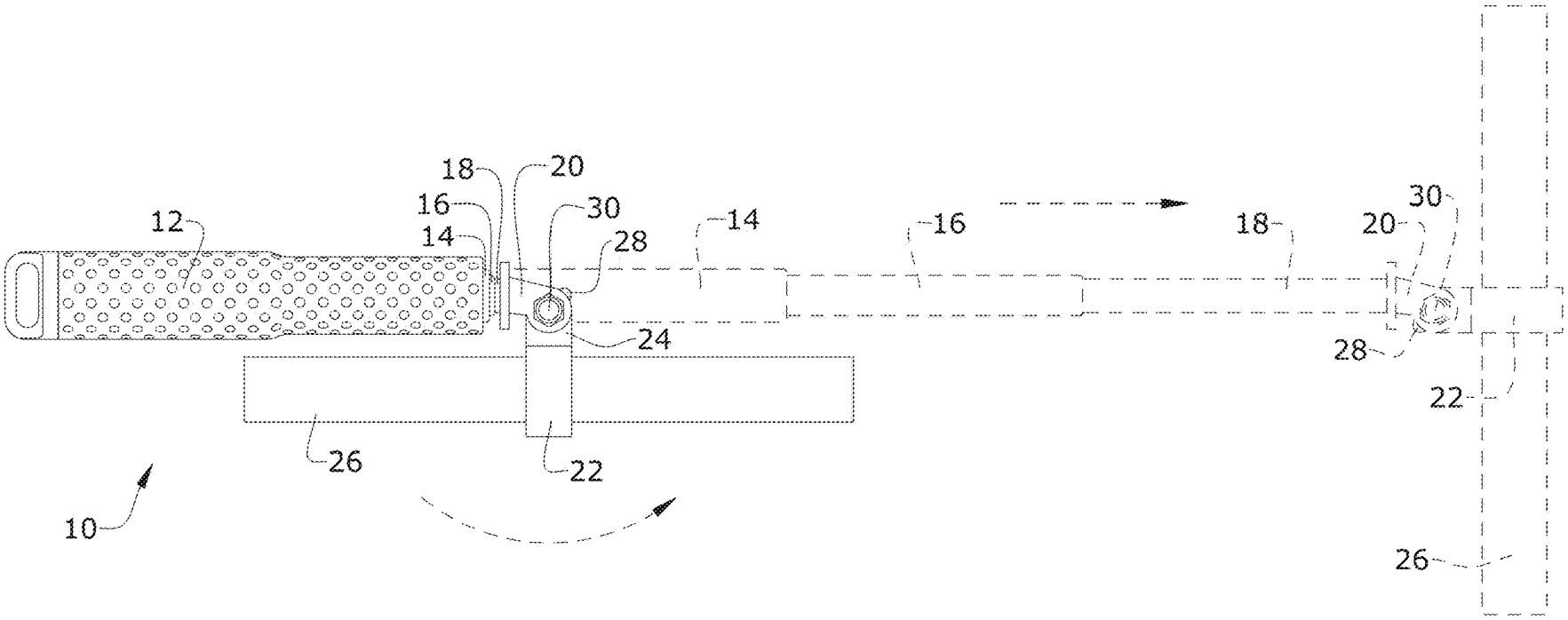
FIG. 4 is a front view of the embodiment of the present invention, showing both the extended and retracted positions thereof, with the extended position illustrated in phantom.
Figure 5:
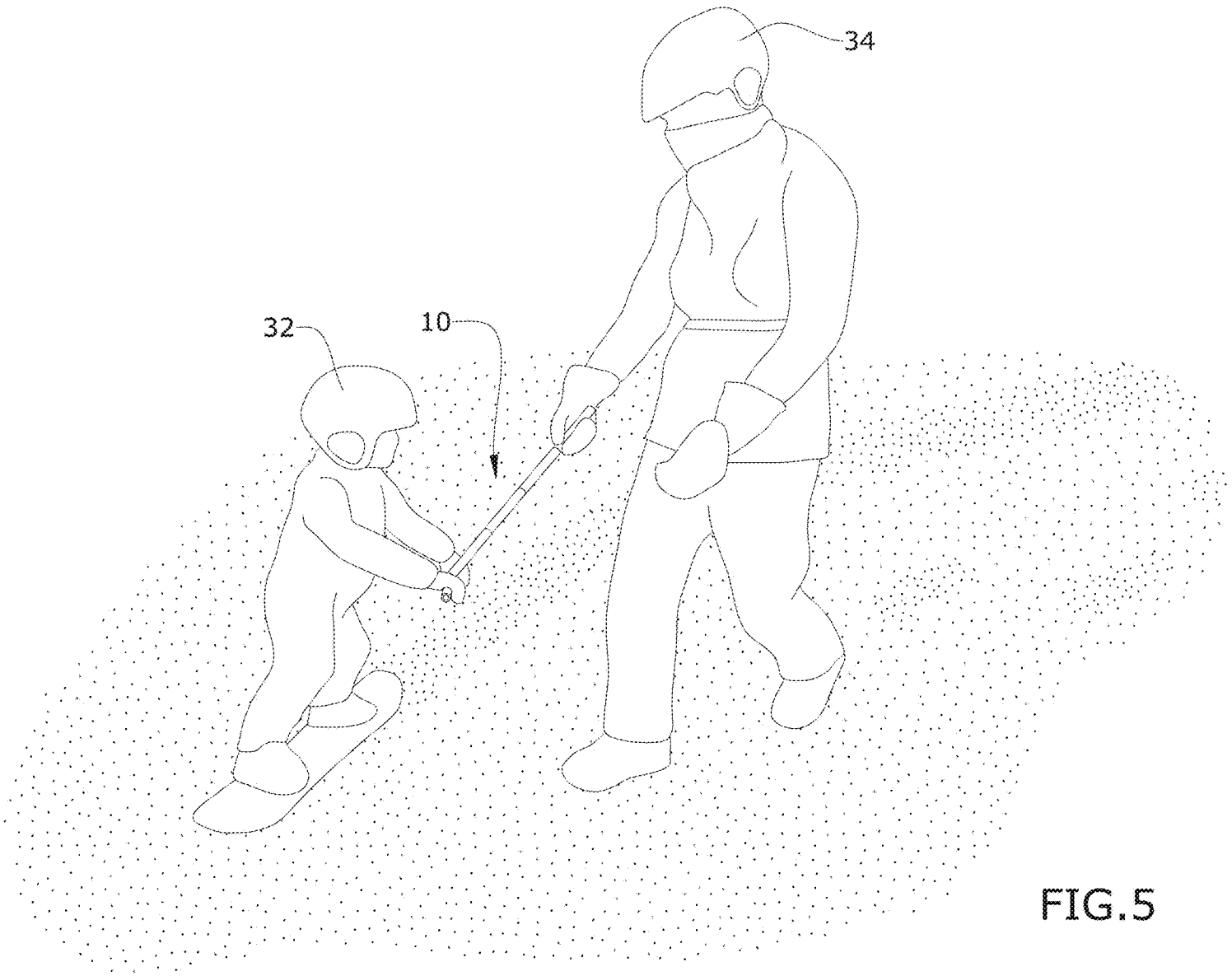
FIG. 5 is a perspective view of the embodiment of the present invention, shown in-use.

The handlebar 26 is coupled to the hinge ring 22 of the hinge unit. As described above, it is rotatable between a position perpendicular to the telescoping unit and parallel thereto. As shown in FIG. 4, the handlebar 26 is coupled to the hinge unit at a central portion thereof such that it extends approximately the same lateral distance away from the hinge ring 22 of the hinge unit in both directions, forming a T-shape when the training device 10 is in an extended position. More specifically, opposing distal ends (relative to the lengthwise longitudinal direction of the handlebar 26) are distanced from the hinge unit by this configuration. Thus, both sides of the handlebar 26 can be grasped by both hands of a student 32, as demonstrated in FIG. 5.

Figure 6:
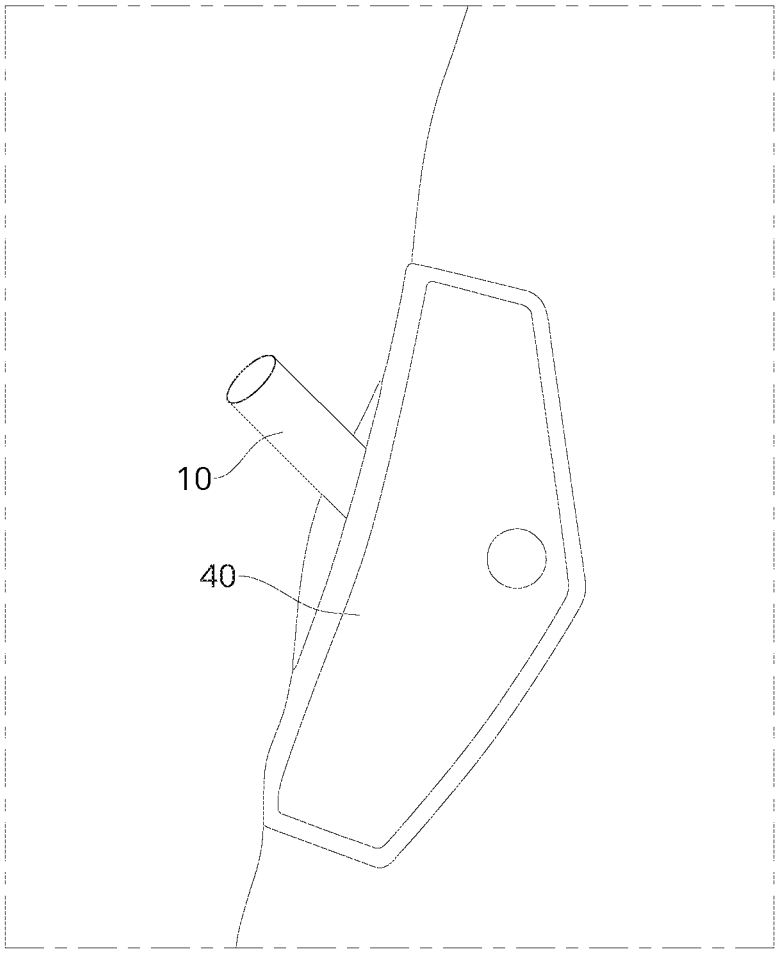
FIG. 6 is a front view of the embodiment of the present invention, shown in the retracted position and disposed in a storage location.

An exemplary use case is as follows. A teacher or trainer 34 may retain the training device 10 in a retracted position in their pocket, bag, backpack, or other storage location 40, as shown in FIG. 6. Due to the compact size of the device 10, it may be stored in any number of places conveniently. When ready to use the device 10, the trainer 34 first removes it from where it is being stored. Then, the telescoping unit may be slid out to an extended position, and the handlebar 26 may be rotated from parallel the telescoping unit to perpendicular thereto. The locking mechanism 28, 30 may be adjusted to retain the handlebar in position. The trainer 34 may grasp the handle 12 and direct a student 32 (e.g., a child) to grasp the handlebar 26 with both of their hands. In certain embodiments of this method, the trainer 34 may be standing on the ground, but those with skill in the art will appreciate that the trainer 34 may also be on a snowboard helping to guide the student 32 down a snow-covered slope. When the training device 10 is no longer needed, the locking mechanism 28, 30 can be adjusted to permit the handlebar 26 to rotate parallel the telescoping unit, and the telescoping unit can be collapsed back down to a retracted position for storage and transport.

While the primary use case intended is to be used as a teaching aid for snowboarding students, other uses may be appropriate that require a telescoping portion with a rotatable handlebar, and are within the spirit and scope of the present disclosure.

To make the present invention, a plurality of telescoping sections may be formed from any appropriate materials (e.g., plastic, aluminum, etc.). A rubber grip may be added to the outermost section to form the handle 12. The handlebar 26 may be formed from, for example, cut tubing, and may be coupled to or formed as integral with the hinge. The hinge should be formed such that the handlebar 26 is rotatable relative to the telescoping sections including: perpendicular to the telescoping section and parallel to the telescoping section. Those with skill in the art will appreciate that, while many of the components are described as separate, such as the hinge 20 and telescoping unit, in certain embodiments the hinge 20 may be directly incorporated or integral with the telescoping unit to reduce the cost and complexity of the design, while maintaining the same functionality.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. For example, the terms parallel and perpendicular are intended to encompass angles approximately at 0 degrees and approximately at 90 degrees. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

What is claimed is:

1. A training device for snowboarding, the training device comprising:

a telescoping unit comprising a plurality of telescoping sections that are slidably coupled with one another, with a first end of the telescoping unit comprising a grip;

a hinge unit coupled to a second end of the telescoping unit;

a locking mechanism adjustably coupled to the hinge unit, wherein the locking mechanism comprises an adjustment member threaded onto a connector such that rotation of the adjustment member selectively applies and releases pressure on the hinge unit; and a handlebar coupled to the hinge unit at a center region thereof such that opposing longitudinal distal ends of the handlebar are spaced from the hinge unit, with the handlebar being rotatable as a single unit between:

a first position, where the handlebar extends substantially perpendicular relative to the telescoping unit, and a second position, where the handlebar extends substantially parallel relative to the telescoping unit, wherein the training device is configured to be compact enough in the second position to fit in a pocket when the telescoping unit is in a retracted position.

2. The training device of claim 1, wherein the plurality of telescoping sections are slidable between an extended position and a retracted position, and wherein the telescoping unit is lockable at varying lengths to achieve different distances between a trainer and a student.

3. The training device of claim 2, wherein the locking mechanism is configured to lock the handlebar in either the first position or the second position by applying pressure through the threaded adjustment member, and wherein the handlebar forms a T-shape with the telescoping unit when in the first position and the telescoping unit is in the extended position.

4. The training device of claim 3, wherein the handlebar is configured to rotate via the hinge unit, and wherein the hinge unit comprises a hinge and a hinge ring rotatably coupled to the hinge via hinge fingers, with the locking mechanism extending through the hinge fingers.

5. A method of teaching snowboarding, the method comprising the steps of:

providing the training device of claim 1;

removing the training device from a storage location comprising a pocket;

sliding the plurality of telescoping sections from a retracted position to an extended position;

rotating the handlebar as a single unit from the second position to the first position to form a T-shape; and adjusting the locking mechanism by rotating the adjustment member to lock the handlebar in the first position.

6. The method of claim 5, further comprising the steps of:

grasping the handlebar with first and second hands of a first user, wherein both hands grasp the single handlebar at positions spaced from the hinge unit; and grasping the grip with at least one hand of a second user.

7. The method of claim 6, wherein, when grasping the handlebar, the first user stands on a snowboard, and wherein the training device provides balance assistance specifically adapted for snowboarding dynamics.

8. The method of claim 7, wherein the handlebar is configured to rotate as a single unit via the hinge unit, and wherein the T-shape configuration provides optimal leverage for snowboard training.

9. The method of claim 8, further comprising the steps of:

adjusting the locking mechanism by rotating the adjustment member to unlock the handlebar from the first position;

rotating the handlebar as a single unit from the first position to the second position;

sliding the plurality of telescoping sections to a retracted position; and inserting the training device into the storage location.

10. The method of claim 9, wherein the storage location is a pocket, and wherein the compact configuration achieved by the parallel handlebar position and retracted telescoping unit enables pocket storage.

11. The training device of claim 1, wherein the grip comprises a rubber grip disposed on an outermost telescoping section, and wherein the handlebar is formed from cut tubing.

* * * * *